US006755324B2

(12) United States Patent
Geshay

(10) Patent No.: US 6,755,324 B2
(45) Date of Patent: Jun. 29, 2004

(54) TRANSPORTING/DISPENSING PACKAGE FOR PLURAL BEVERAGES

(75) Inventor: James F. Geshay, Racine, WI (US)

(73) Assignee: Bib Pak, Inc., Racine, WI (US)

( * ) Notice: Subject to any disclaimer, the term of this patent is extended or adjusted under 35 U.S.C. 154(b) by 52 days.

(21) Appl. No.: 10/134,772

(22) Filed: Apr. 29, 2002

(65) Prior Publication Data

US 2003/0201280 A1 Oct. 30, 2003

(51) Int. Cl.[7] ..... G01F 11/00

(52) U.S. Cl. ..... 222/1; 222/94; 222/105; 222/185.1; 229/120.18; 229/117.35

(58) Field of Search ..... 222/1, 94, 105, 222/129, 183, 184, 185.1; 229/120.11, 120.18, 117.35

(56) References Cited

U.S. PATENT DOCUMENTS

| | | | | | |
|---|---|---|---|---|---|
| 3,233,817 | A | | 2/1966 | Casady | 229/14 |
| 3,349,960 | A | | 10/1967 | Ketler | 221/96 |
| 4,516,692 | A | * | 5/1985 | Croley | 222/105 |
| 4,541,526 | A | | 9/1985 | Berg et al. | 206/44.12 |
| 4,815,631 | A | * | 3/1989 | Eeg et al. | 229/117.3 |
| 5,050,775 | A | | 9/1991 | Marquardt | 222/93 |
| 5,186,359 | A | * | 2/1993 | Brown et al. | 222/1 |
| 5,197,660 | A | * | 3/1993 | Colling | 229/120.11 |
| 5,715,992 | A | | 2/1998 | Andrews, Sr. et al. | 229/125.15 |
| 5,826,752 | A | | 10/1998 | Latimer | 222/105 |
| 5,909,841 | A | | 6/1999 | Andrews, Sr. et al. | 229/125.15 |
| 6,062,431 | A | | 5/2000 | Geshay | 222/105 |
| 6,196,452 | B1 | | 3/2001 | Andrews, Sr. et al. | 229/125.15 |
| 6,290,124 | B2 | | 9/2001 | Andrews, Sr. et al. | 229/117.27 |
| 2001/0002027 | A1 | * | 5/2001 | Dean | 222/23 |

OTHER PUBLICATIONS

Almaden Vineyards' Printout From Internet re: Packaging.

* cited by examiner

*Primary Examiner*—Joseph A. Kaufman
(74) *Attorney, Agent, or Firm*—Jansson, Shupe & Munger, Ltd.

(57) ABSTRACT

A transporting/dispensing package for plural beverages including a carton (10), a pair of flaccid bags (12, 14) within the carton each bag having a fill spout (34, 36) secured to one of two sections (56, 58) of a spout-securing panel and a dispensing device (30, 32) secured to a front panel (22), and a bag-separation panel (46) between the bags. A pre-erected carton formed of a unitary blank and two flaccid bags, such pre-erected carton being easily erectable to form a package, and a method for transporting and dispensing more than one beverage.

25 Claims, 8 Drawing Sheets

TRANSPORTING/DISPENSING PACKAGE FOR PLURAL BEVERAGES

FIELD OF THE INVENTION

This invention relates generally to beverage containers and, more particularly, to apparatus and methods for transporting and dispensing beverages.

BACKGROUND OF THE INVENTION

Gourmet coffee shops have gained a large share of the beverage market in recent years. These shops typically sell individual servings of upscale brands of coffee. These servings are usually packaged in single serving cups that are suitable for carryout orders. When such orders are for several people, some of whom may be absent at the time of purchase, several cups (perhaps four or even as many as six) may need to be carried in a cardboard cup-holder.

These gourmet coffee shops so changed the public's taste for coffee that such coffee increasingly came to be requested as part of a coffee service for large gatherings or groups, such as meetings and the like. As a result of this demand, various beverage transport and service containers were developed and have been widely used in the industry. An example is the container described in U.S. Pat. No. 6,196,452 B1 (Andrews, Sr. et al.). One particularly useful such container is the package for beverages described in U.S. Pat. No. 6,062,431 (Geshay) owned by BIB Pak, Inc., Racine, Wis.

One impediment to the serving of gourmet coffee at large gatherings that is not addressed by these other containers, however, is the absence of one that is capable of efficiently transporting and serving more than one type of beverage by itself. In the field of coffee service, when coffee is being prepared for a group of people, it is most often necessary that at least regular and decaffeinated coffees be available. While such demand can be satisfied by utilizing more than one container, this has apparent disadvantages with respect to transport and cost. These problems have persisted despite the high demand for convenient transporting and service of multiple coffees to large groups.

Therefore, an apparatus that would permit one to transport and serve more than one type of beverage at a time, be it coffee or any other type of drink, would be an important advancement in the art.

OBJECTS OF THE INVENTION

It is an object of the invention to provide an improved beverage package overcoming some of the problems and shortcomings of the prior art.

Another object of this invention is to provide an improved beverage package that is capable of transporting more than one beverage in a single container from a point of retail sale of those beverages and of dispensing those beverages in individual servings from the same container.

Another object of this invention is to provide an improved beverage package that is easy to fill with two different types of beverage at the point of retail sale.

Another object of this invention is to provide an improved beverage package that accepts two different beverages and involves a carton formed of a unitary cardboard blank which is easy to erect for use.

Another object of this invention is to provide an improved beverage package that secures fill spouts on beverage bags within the carton and protects the fill spouts from damage during transport.

These and other objects of the invention will be apparent from the following descriptions and from the drawings.

SUMMARY OF THE INVENTION

This invention is an improvement in beverage packages particularly adapted for the transporting and dispensing of more than one type of beverage.

In this invention, the beverage package includes a carton, a pair of flaccid bags within the carton where each bag has a fill spout secured to a spout-securing panel and a dispensing device secured to a front panel, and a bag-separation panel between the two bags. More specifically, the carton includes the front panel, a rear panel and at least two side panels spaced between the front and rear panels. The top portions of these panels define an upper opening to the carton into which the spout-securing panel is placed. On each of the flaccid beverage bags, the dispensing device is attached to the bottom of the bag and the fill spout is attached to the top of the bag. The dispensing devices of the bags extend through the lower portion of the front panel to secure them to the carton. The fill spouts extend through the spout-securing panel to likewise secure them inside the carton. The bag-separation panel is located inside of the carton and extends down between the two bags to promote the unobstructed filling of each bag. By allowing each bag to fill unobstructed by the other, this panel provides ease in the use of the package at the point of purchase of the beverages being transported.

It is preferred that the bag-separation panel be attached to the front panel and the rear panel, and most preferred that the bag-separation panel have an upper edge abutting the lower surface of the spout-securing panel. This configuration allows the spout-securing panel to be supported by the bag-separation panel when placed inside the carton. The support provided the spout-securing panel in turn enables the beverage bags secured by it to be filled with greater ease and less chance of spilling.

In certain embodiments of this invention, the beverage package also includes a cover panel that extends over the top of the carton and the spout-securing panel inside. In particularly preferred embodiments, such cover panel is contiguous with (i.e., integral with) the upper edge of the front panel of the carton. The cover panel serves to protect the fill spouts from damage during transport.

It is particularly preferred that the upper portion of side panels on each side of the carton have apertures to serve as handle openings for the beverage package, or to allow attachment of handles. These handle openings assist the user in carrying the package by hand. In a most preferred embodiment, latch flaps attached to the sides of the cover panel can be inserted into the handle openings to better secure the cover panel to the top of the carton.

In certain highly preferred embodiments, the front, rear, side, and spout-securing panels are individual parts of a unitary (or single) blank with fold lines that allow it to be erected into the carton of the beverage package. This feature allows for ease in manufacture and storage of the package. Moreover, the part of the blank comprising the spout-securing panel is pre-cut to create a pair of fill apertures for receiving each of the fill spouts when the beverage bags are added to the carton. Likewise, the portion of the blank constituting the front panel is pre-cut to create a pair of dispensing apertures for receiving each of the dispensing devices attached to the bags. It is particularly preferred that the blank further include the bag-separation panel as one of its sections. A more preferred embodiment is one where the blank is formed from corrugated cardboard material.

In certain embodiments, the blank has bottom flaps contiguous with the bottom of each of the front, rear, and side panels. When the blank is later erected into a carton, these flaps are simply folded back in the direction of the interior of the carton. Use of the flaps in this manner reinforces the rigidity of the bottom of the package, giving added stability as it is placed down onto a flat surface where it will rest during beverage dispensing. In preferred embodiments, a bottom panel is attached to one of the bottom flaps to form a bottom to the carton when the blank is erected.

Another preferred embodiment is one where the rear panel portion of the unitary blank is composed of two non-contiguous rear-panel sections. When the carton is erected, one rear-panel section overlaps the other so that the two sections can be adhered to one another to form a completed rear panel. In addition, the spout-securing panel in this embodiment of the blank is composed of two non-contiguous spout-panel sections, each spout-panel section being contiguous with the top edge of a different rear-panel section. Each spout-panel section has one of the pre-cut fill apertures and, when the carton is erected, one spout-panel section overlaps the other so that the two sections can be adhered to one another to form a completed spout-securing panel.

In a more preferred embodiment, the bag-separation panel is part of the unitary blank by being contiguous with one of the rear-panel sections—the rear-panel section that has an outer surface overlapped by the inner surface of the other rear-panel section. In other words, the bag-separation panel is contiguous with the rear-panel section which is the inner section.

The unitary blank also preferably includes the cover panel, mentioned above, which (as already noted) creates a protective internal cavity within the carton to prevent disruption or inadvertent opening of the fill spouts during transport or during later handling when the beverages are dispensed.

The unitary corrugated cardboard blank, which is erected easily into a carton for transporting and dispensing two beverages, is further described as having: (1) a first rear-panel section, a first side panel, a front panel, a second side panel, and a second rear-panel section, such sections and panels here recited in their contiguous ordered seriatim relationship; (2) first and second spout-panel sections contiguous with the upper edges of the first and second rear-panel sections, respectively; and (3) a bag-separation panel contiguous with the lateral edge of one of the rear-panel sections. The rear-panel sections, given their placement on the blank, are non-contiguous and (upon erecting) have overlap portions which constitute the areas where one section adheres to the other (i.e., by use of adhesive) to form the rear panel of the carton. The spout-panel sections are non-contiguous and have overlap portions which constitute the areas where one section is adhered to the other to form the spout-securing panel of the carton. Each spout-panel section has a pre-cut fill aperture to accommodate and secure the fill spout of one of the two beverage bags. And, as already noted, the front panel has a pair of pre-cut dispensing apertures to accommodate and secure the dispensing devices on the same two bags.

The unitary blank also preferably has: the cover panel at a location contiguous with the upper edge of the front panel; the bottom flaps at locations contiguous with the bottom edges of the front panel, each of the side panels, and each of the rear-panel sections; and, most preferably, the bottom panel contiguous with the outer edge of the bottom flap which is contiguous with the front panel. Each of the other four bottom flaps is preferably provided with a lock tab and the bottom panel is formed with four slots to accept these tabs. On erecting the carton from the blank, the bottom flaps and bottom panel are folded in the direction of what will be the interior of the carton. This allows the lock tabs to be inserted into respective slots on the bottom panel to form a bottom to the beverage package.

Certain embodiments of this invention involve what is referred to herein as a "pre-erected" two-beverage carton which is a the aforementioned unitary corrugated cardboard blank with certain portions thereof attached, such that later erection of the carton involves minimal steps. More specifically, the two rear-panel sections are adhered to one another and the two spout-panel sections are adhered to one another. In such embodiments, it is most preferred that the two flaccid bags be secured to the pre-erected carton by attachment of the dispensing devices at the bottoms of the two bags through to the lower portion of the front panel of the carton. Moreover, with the carton in such pre-erected condition, the bags are separated from each other by the bag-separation panel within the pre-erected carton. Later, when the pre-erected carton is erected to prepare it for use, the fill spouts at the tops of each of the two bags are attached to their respective spout-panel sections. The pre-erected package is quite flat, which makes it easy to ship and store.

The invention further includes a method for providing two beverages in amounts where it can be consumed by a group of people at their leisure over an extended period of time. The method of this invention begins with the step of providing a unitary non-erected carton that can be used to form an upright carton. The collapsed carton encloses two flaccid bags in horizontally-adjacent side-by-side positions with a bag-separation panel between them. When erected, the carton includes a lateral wall a lower portion of which has dispensing devices of the bags secured thereto. The carton is then erected so as to permit the two bags to be filled with two beverages. The bags are afterwards closed. The filled carton is next transported to the desired location where the beverages contained therein are then selectively dispensed into cups held beneath the dispensing devices.

In certain preferred embodiments of this method, the two flaccid bags have their dispensing devices attached to the bottom of the bags and also have fill spouts which are attached to the top of the bags, the fill spouts being secured to an upper portion of the erected carton. The bags are then filled through their fill spouts, which are also used to close the bags. It is particularly preferred that the erected carton include a cover to be placed on top of the carton so as to enclose the fill spouts within the carton after the bags are filled and the fill spouts closed.

This invention further includes a beverage transporting and dispensing package that includes a unitary collapsed carton which, when erected, has two flaccid beverage bags enclosed in the carton in horizontally-adjacent side-by-side positions, a bag-separation panel between the bags, and a pair of dispensing devices, one on each of the bags, extending through and secured to the lower portion of a lateral wall on the carton. The bag-separation panel, as noted, is preferably integral with other portions of the carton, and it is preferred that there be a fill spout at the top of each beverage bag.

Certain terms used in this document have particular meanings which are set forth as follows:

The term "contiguous" refers to panels, sections or the like of a unitary blank which are adjacent to one another and integrally formed, as when such adjacent parts are created by folding, scoring or the like (e.g., of corrugated cardboard).

The term "pre-erected" refers to a carton in its collapsed (or, more accurately, its not-yet-erected) condition.

DETAILED DESCRIPTIONS OF PREFERRED EMBODIMENTS

Figure 1:
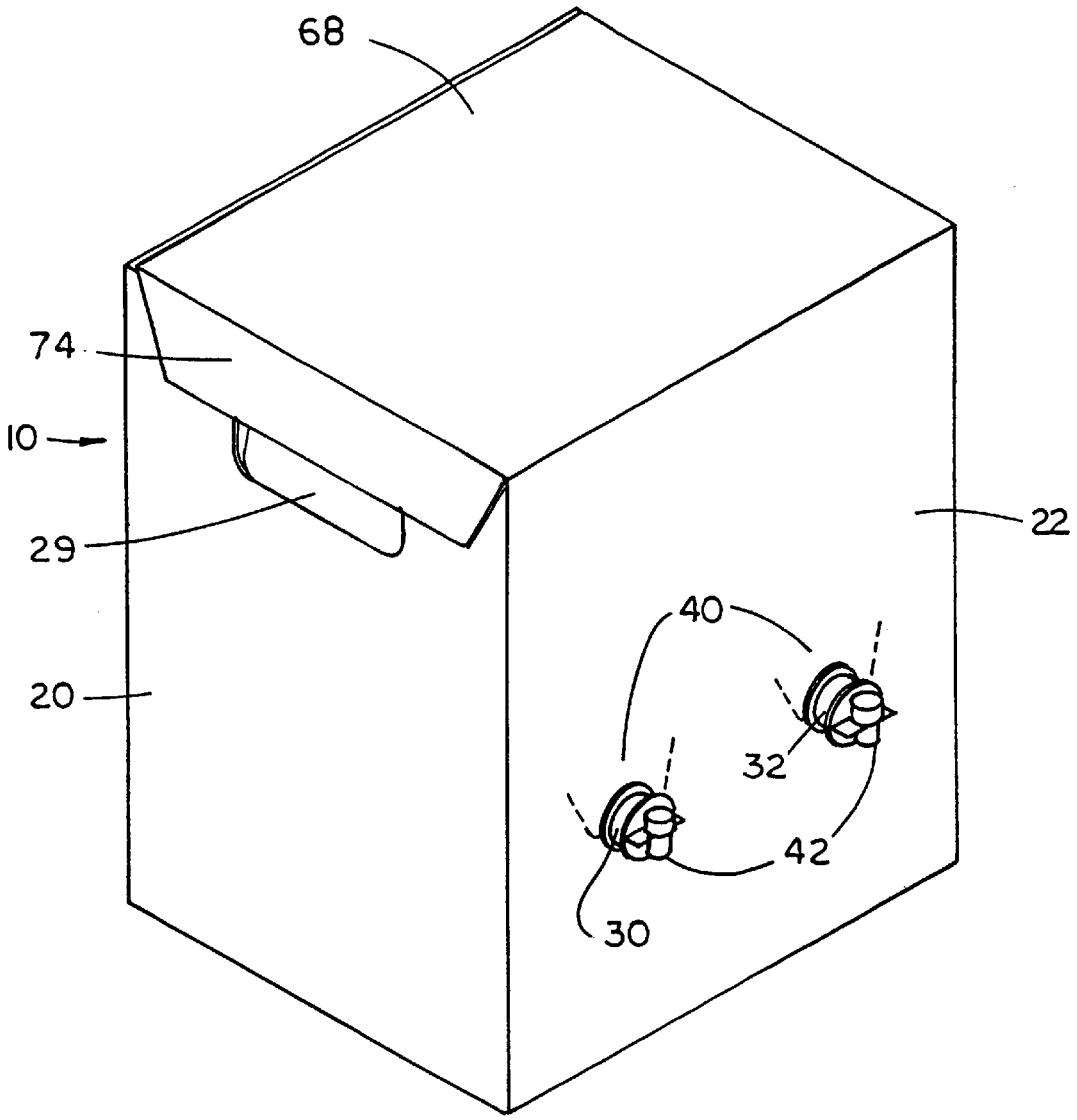
FIG. 1 is a perspective view of the new package.
Figure 2:
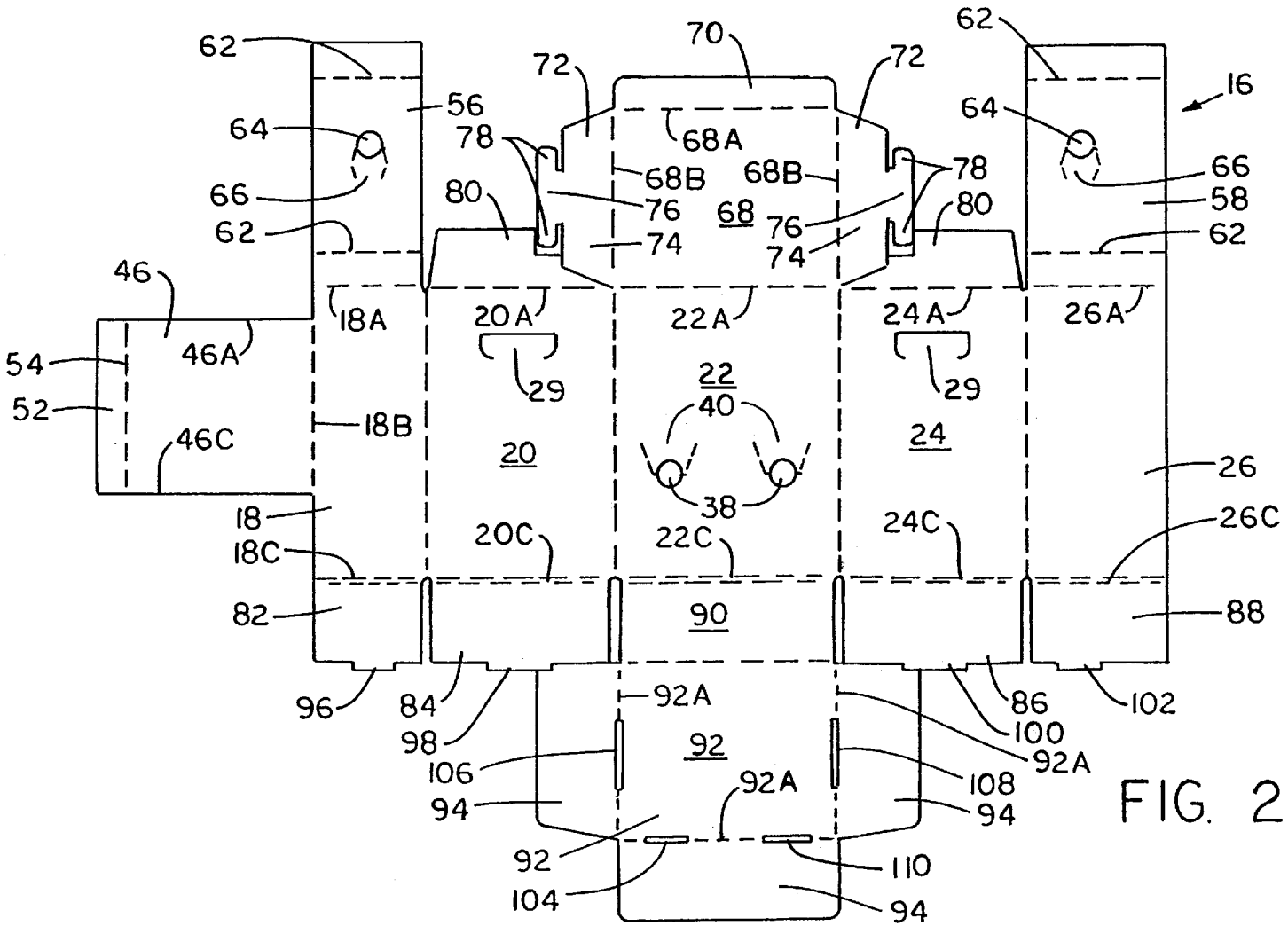
FIG. 2 is a plan view of a corrugated cardboard blank used to make the new package of FIG. 1.
Figure 8:
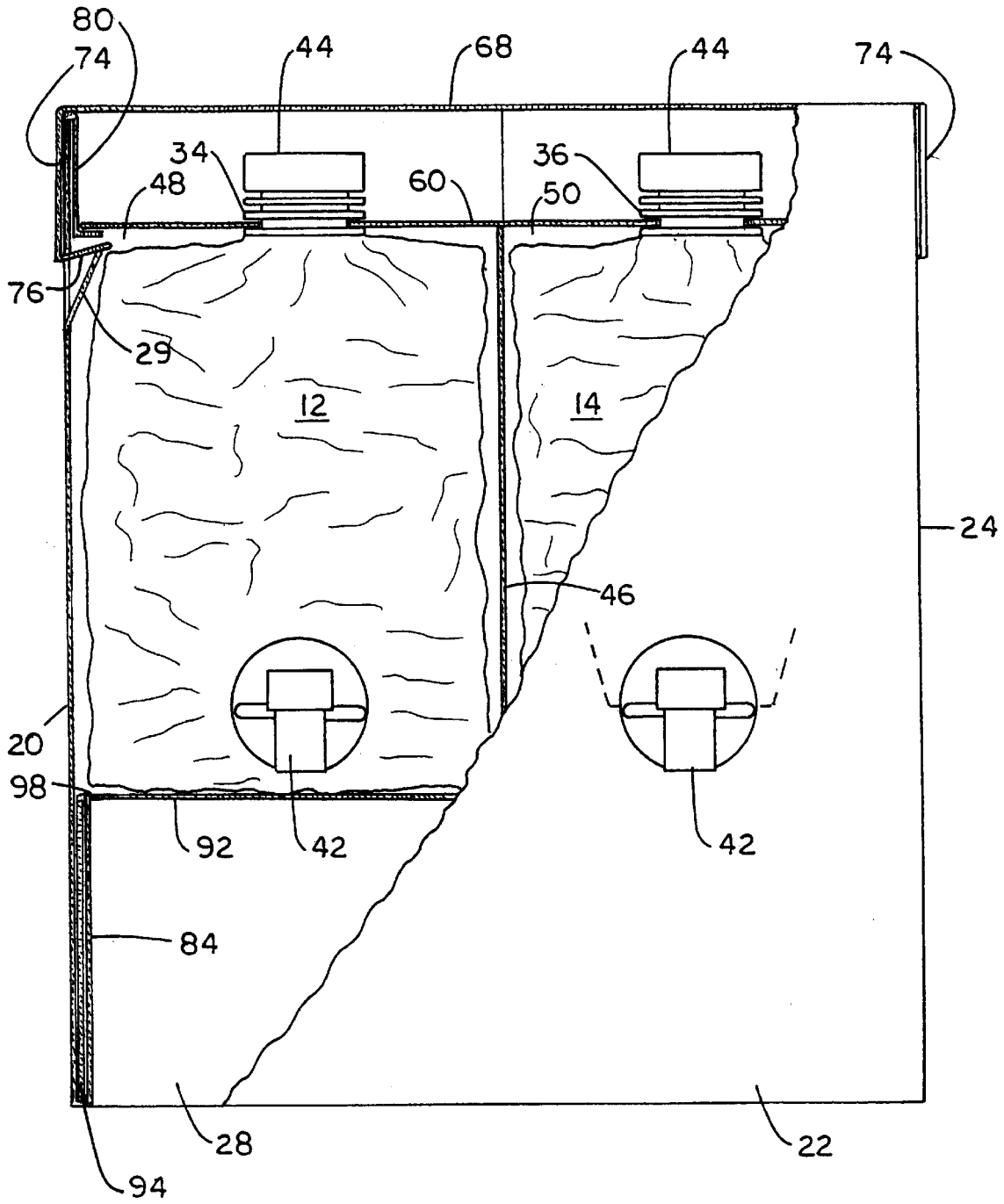
FIG. 8 is a cutaway front elevation view of the new package.

The drawings and FIG. 1 in particular illustrate a new beverage transporting and dispensing package. As shown in FIG. 8, the package includes a carton 10 and two flaccid beverage bags 12, 14. Carton 10 is formed from a unitary die-cut corrugated cardboard blank 16, shown in FIG. 2. Fold lines on blank 16 are shown as dashed lines on FIG. 2. Double dashed lines on FIG. 2 represent a rolled edge on blank 16.

Figure 4:
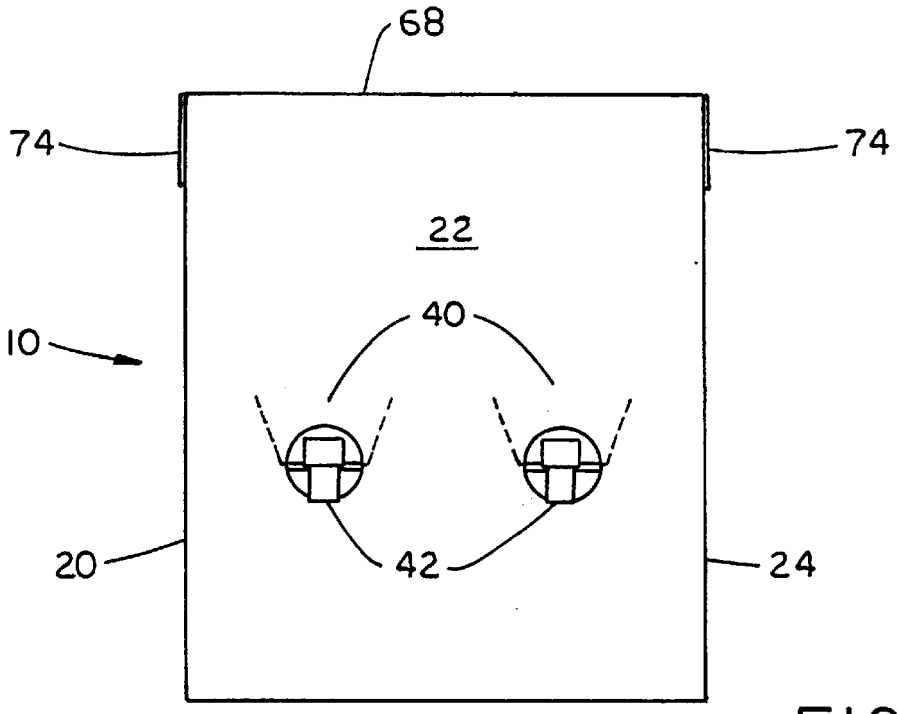
FIG. 4 is a front elevation view of the new package.
Figure 5:
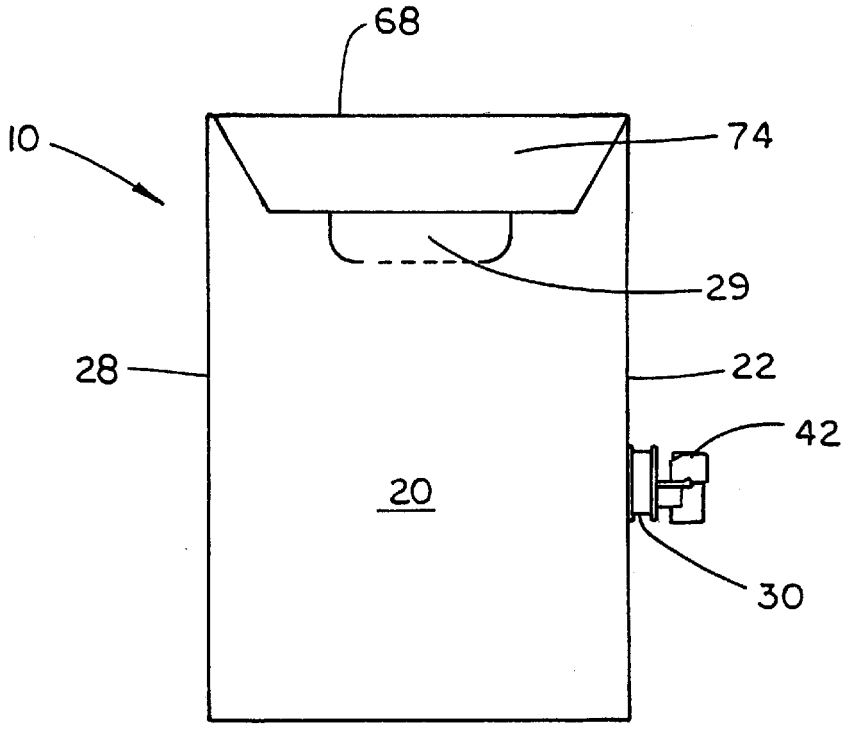
FIG. 5 is a side elevation view of the new package.
Figure 6:
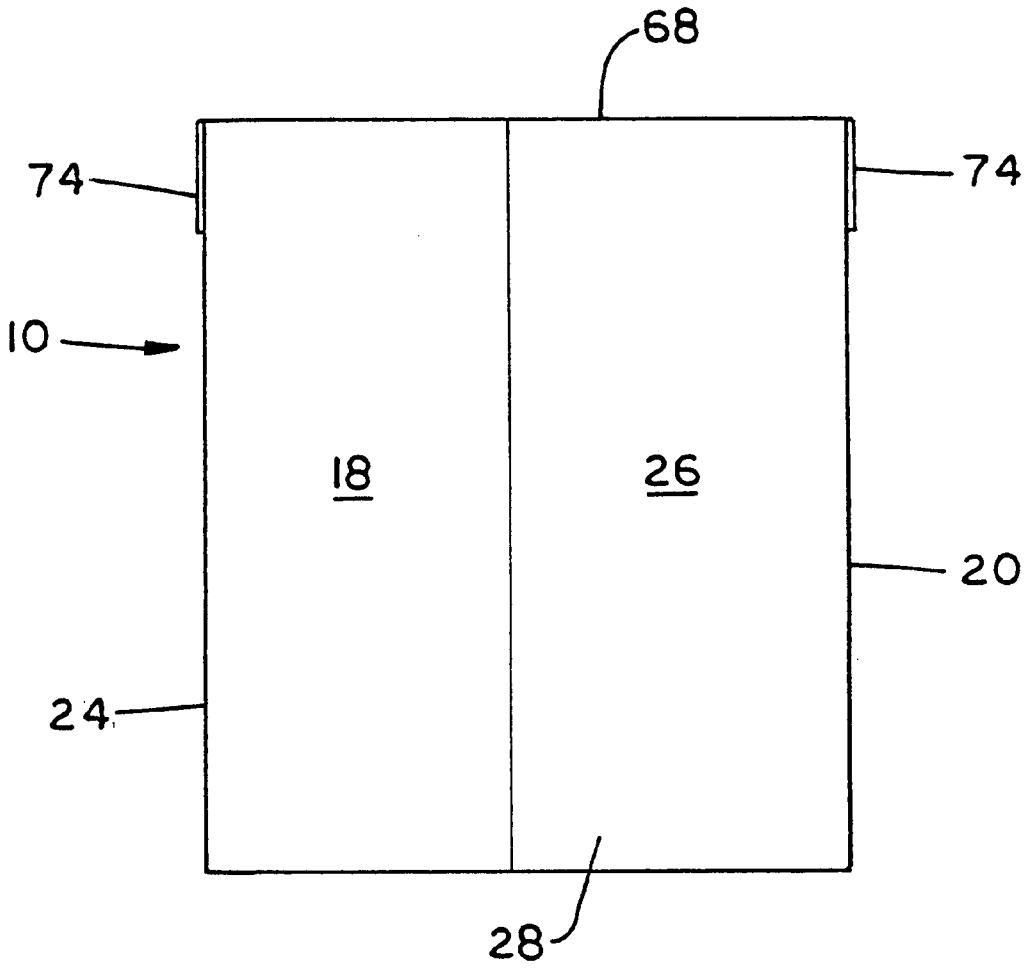
FIG. 6 is a rear elevation view of the new package.

Blank 16 includes a first rear-panel section 18, a first side panel 20, a front panel 22, a second side panel 24, and a second rear-panel section 26. When carton 10 is erected for use, first rear-panel section 18 and second rear-panel section 26 form the rear panel 28. First and second side panels 20 and 24 extend a equal distance between front and rear panels 22 and 28 when carton 10 is erected for use. Blank 16 also includes a scored handle opening 29 on each side panel 20, 24. Handle openings 29 are pushed out when carton 10 is erected for use. Handle openings 29 assist the user in transporting the beverage package by hand. In the erected package, as shown in FIGS. 4, 5, and 6, front and rear panels 22 and 28 are generally parallel to one another and the panels 20 and 24 are generally parallel to one another.

Figure 7:
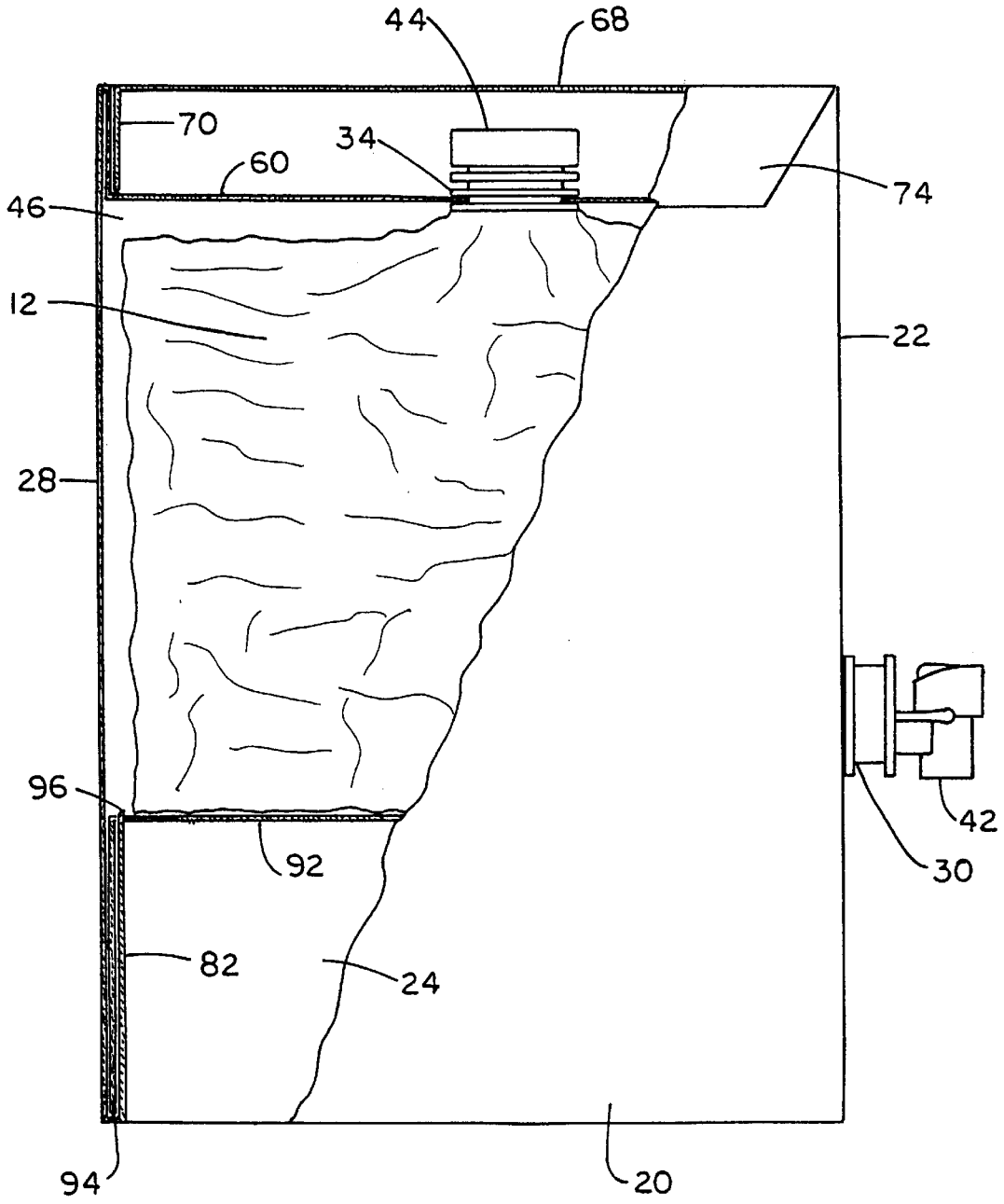
FIG. 7 is a cutaway side elevation view of the new package.

As seen in FIGS. 7 and 8, first and second beverage bags 12 and 14 have attached thereto first and second dispensing devices 30 and 32, respectively, and first and second fill spout 34 and 36, respectively. To accommodate dispensing devices 30 and 32, front panel 22 of blank 16 includes a pair of scored dispensing apertures 38 and dispensing flaps 40. In a highly preferred embodiment, dispensing apertures 38 are located on front panel 22 at a height sufficiently above a lower edge 22C thereof to allow an eight (8) ounce cup to be easily placed beneath either dispensing device 30, 32 when the package is fully erected. The location of dispensing apertures 38 on front panel 22 with respect to lower edge 22C will vary with the dimensions of carton 10. The location shown in FIGS. 1, 2, 3, 4, 5, 7, 8, and 9 is representative of just one embodiment.

Figure 3:
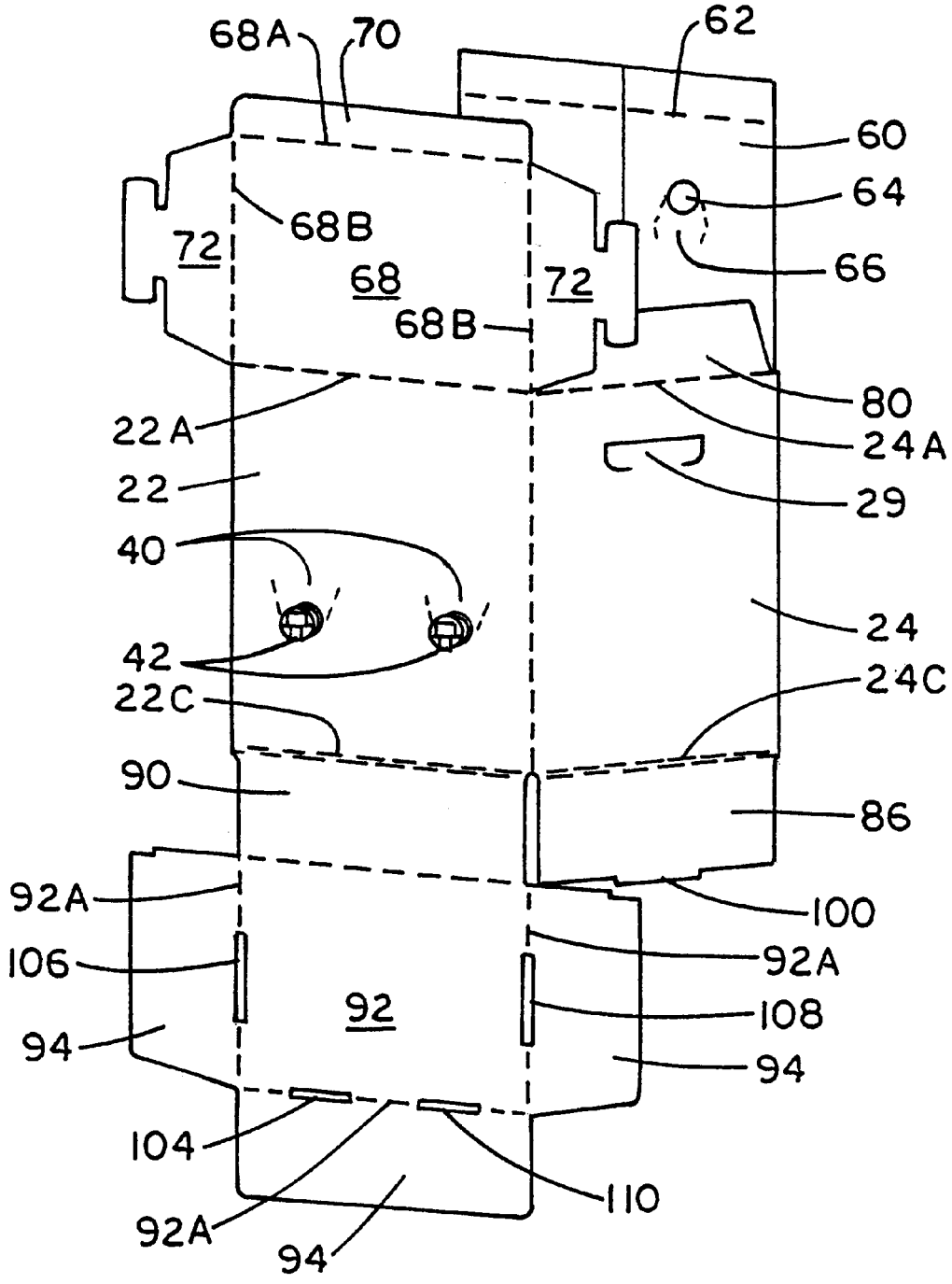
FIG. 3 is a perspective view of the new package in a pre-erected configuration for shipping or storage.

Each dispensing device 30, 32 has a spring-closed spigot 42 affixed to its neck. When carton 10 is partially assembled in a folded configuration for shipping as shown in FIG. 3, scored dispensing apertures 38 are pushed out and dispensing flaps 40 released to allow dispensing devices 30 and 32 with their attached spigots 42 to be urged through the resulting openings. When this is completed, flaps 40 can be restored to their original position. In certain embodiments, beverage bags 12 and 14 are attached to partially assembled carton 10 at the point of retail sale because of the fact that bags 12 and 14 and carton 10 were shipped separately. In such instances, the above process is performed by the user.

Figure 9:
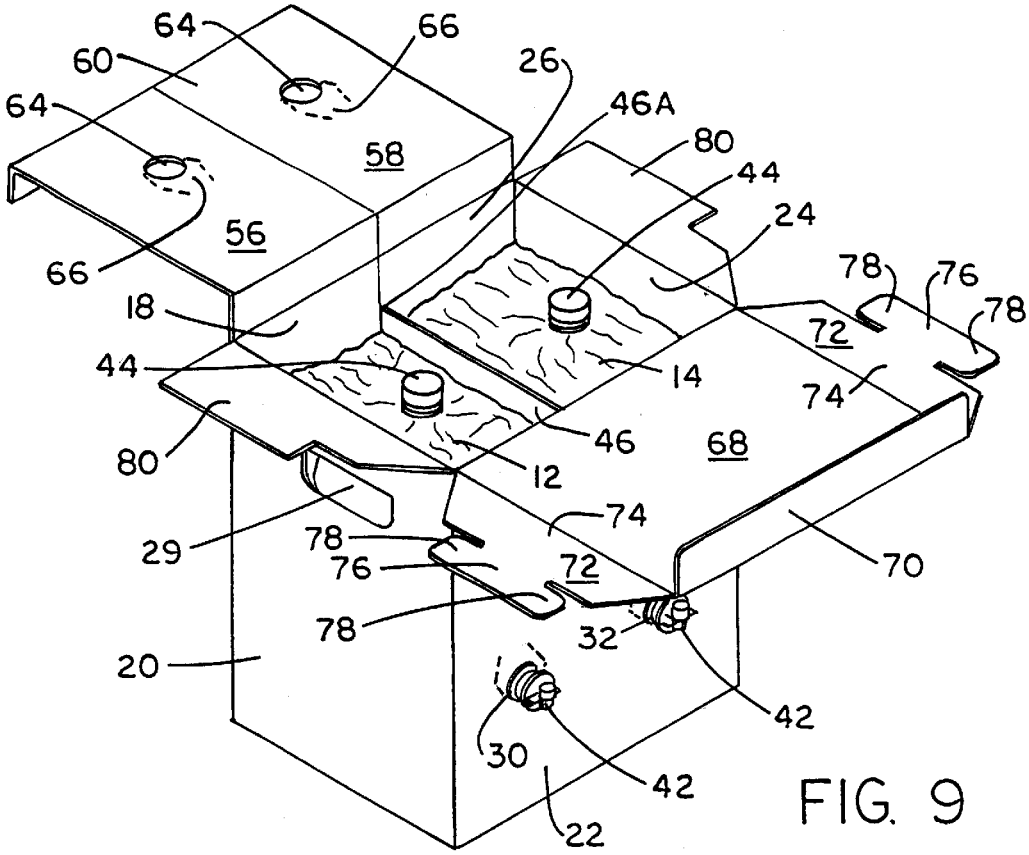
FIG. 9 is a perspective view of the top of the new package.
Figure 10:
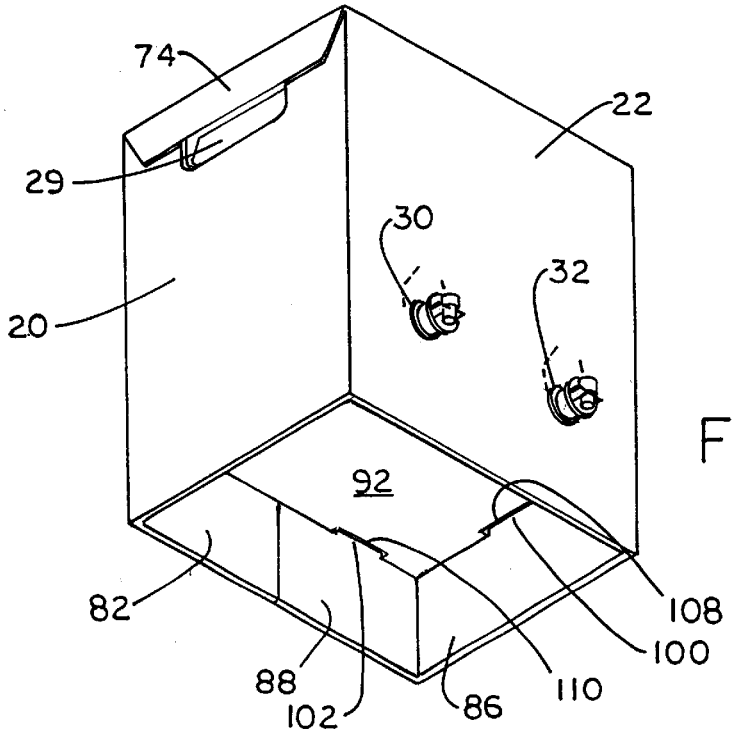
FIG. 10 is a perspective view of the bottom of the new package.

Dispensing devices 30 and 32 are attached to beverage bags 12 and 14 at locations near the bottoms of the bags that allow efficient emptying of the contents of the bags when full. Fill spouts 34 and 36 are attached to beverage bags 12 and 14 at locations near the tops of the bags that allows efficient filling of the bags by the user. As shown in FIGS. 7, 8, and 9, fill spouts 34 and 36 have closure caps 44 that are screwed off to permit filling of the bags with a beverage and then is screwed back on to seal the bags after they are filled.

In a highly preferred embodiment, as shown in FIG. 2, blank 16 further includes a bag-separation panel 46 extending from a lateral edge 18B of first rear-panel section 18. When carton 10 is erected from blank 16, bag-separation panel 46 divides the interior of the carton into two compartments 48 and 50 as shown in FIG. 8. An individual beverage bag 12, 14 is located in each compartment 48, 50.

A glue tab 52 extends from the glue-tab fold 54 of bag-separation panel 46. When carton 10 is partially assembled in a folded configuration for shipping as shown in FIG. 3, tab 52 is glued to the interior surface of front panel 22. Glue-tab fold 54 allows bag-separation panel 46 to fold down when carton 10 is shipped but to then fold back into position when erected at the point of retail sale. In certain embodiments, bag-separation panel 46 may be separate from blank 16. In such instances, panel 46 would be simply folded at glue-tab fold 54 before being urged into carton 10, frictionally held in place between front panel 22 and rear panel 28, to form compartments 48 and 50.

In a highly preferred embodiment, as shown in FIG. 2, blank 16 further includes a first spout-panel section 56 extending from a top edge 18A of first rear-panel section 18 and a second spout-panel section 58 extending from a top edge 26A of second rear-panel section 26. When carton 10 is erected for use, first spout-panel section 56 and second spout-panel section 58 form spout-securing panel 60.

Second rear-panel section 26 and second spout-panel section 58 have a width greater than first rear-panel section 18 and first spout-panel section 56, respectively. When carton 10 is partially assembled to form a folded configuration for shipping as shown in FIG. 3, the interior surface of the overlap portion between second rear-panel section 26 and first rear-panel section 18 is glued to have the two sections adhere to each other in forming rear panel 28 as shown in FIG. 6. Likewise, the interior surface of the overlap portion between second spout-panel section 58 and first spout-panel section 56 is glued to have the two sections adhere to each other in forming spout-securing panel 60 as shown in FIG. 9. In a most preferred embodiment, the process of gluing together first rear-panel section 18 and second rear-panel section 26 as well as first spout-panel section 56 and second spout-panel section 58 can be done in a single operation. It is also most preferred that the width of first rear-panel section 18 be close to half the width of front panel 22. This is preferred to allow bag-separation panel 46 to divide the interior of carton 10 into two nearly equal compartments 48 and 50 and to enable carton 10 to be easily folded or collapsed as flat as possible for shipping and storage for later use.

As shown in FIGS. 2, 8, and 9, when carton 10 is erected from its folded configuration, spout-securing panel 60 is folded inward toward the interior of carton 10 at spout-panel fold lines 62. In a highly preferred embodiment, spout-securing panel 60 will be resting upon an upper edge 46A of bag-separation panel 46. As this is being done, first and second fill spouts 34 and 36 are extended through fill apertures 64 on spout-securing panel 60. Scored fill flaps 66 can be folded out to the extent necessary to assist in urging fill spouts 34 and 36 through fill apertures 64. In certain embodiments, spout-securing panel 60 may be separate from blank 16. In such instances, panel 60 would be simply folded at fold lines 62 before being urged into the upper opening of carton 10 and having fill spouts 34 and 36 secured to panel 60 by means of fill apertures 64.

In a highly preferred embodiment, as shown in FIGS. 2 and 9, blank 16 further includes a cover panel 68 extending out from a top edge 22A of front panel 22. As shown in FIG. 2, cover panel 68 includes a cover-panel tab 70 extending from an outer edge 68A of the panel and two cover-panel latch flaps 72 extending from side edges 68B of the panel. Each latch flap 72 includes a first latch-flap section 74 and a second latch-flap section 76. Each second latch-flap section 76 has a pair of scored latch-flap ears 78. When carton 10 is erected for use and beverage bags 12 and 14 are filled, cover panel 68 is folded over spout-securing panel 60. Cover-panel tab 70 is folded inward and received by the interior of carton 10 above spout-securing panel 60. Latch flaps 72 are folded downward over top edges 20A, 24A of side panels 20 and 24. As shown in FIG. 8, the fold between first latch-flap section 74 and second latch-flap section 76 on each latch flap 72 is about in registry with the top edge of corresponding handle opening 29. Latch-flap ears 78 on each latch flap 72 are folded inward to allow second latch-flap section 76 to be inserted inwardly through and locked to handle opening 29. Latch flaps 72 serve to secure cover panel 68 to the top of carton 10 during use, thereby protecting fill spouts 34 and 36 and their closure caps 44 from damage during transport.

In a highly preferred embodiment, as shown in FIG. 2, blank 16 further includes a cover flap 80 extending from top edges 20A, 24A of each side panel 20, 24. As shown in FIG. 8, these flaps 80 are folded inward when cover panel 68 is closed over the top of carton 10. Flaps 80 reinforce the top edges of side panels 20 and 24 to prevent side tears when a filled package is carried by way of two handle openings 29.

In a highly preferred embodiment, as shown in FIG. 2, blank 16 further includes a first bottom flap 82 extending from a lower edge 18C of first rear-panel section 18, a second bottom flap 84 extending from a lower edge 26C of second rear-panel section 26, a third bottom flap 86 extending from a lower edge 20C of first side panel 20, a fourth bottom flap 88 extending from a lower edge 24C of second side panel 24, and a bottom fold 90 extending from lower edge 22C of front panel 22. A bottom panel 92 extends from bottom fold 90, panel 92 having a bottom-panel wing 94 extending from each of its other three edges 92A.

As shown in FIGS. 3, 7, 8, and 10, when carton 10 is erected from its folded configuration, bottom panel 92 is inserted into carton 10 by folding bottom fold 90 inward and bottom-panel wings 94 outward with respect to the interior of carton 10. In a highly preferred embodiment, bottom panel 92 will be resting against a lower edge 46C of bag-separation panel 46 when panel 92 is fully inserted. After bottom panel 92 is inserted into carton 10, each bottom flap 82, 84, 86, 88 is folded inward so that a corresponding lock tab 96, 98, 100, 102 on each bottom flap can be inserted into corresponding bottom-panel slots 104, 106, 108, 110 located along the perimeter of panel 92. In certain embodiments, bottom fold 90 and bottom panel 92 is replaced by a fifth bottom flap. In such embodiments, each flap is folded inward towards the interior of carton 10 to provide reinforcement of the bottom edges of lateral panels 20, 22, 24, 28 for support when a filled package is resting on those edges.

While the principles of the invention have been shown and described in connection with preferred embodiments, it is to be understood clearly that such embodiments are by way of example and are not limiting. Other versions of this invention would be readily apparent to those of ordinary skill in the art. The spirit and scope of the following claims should not be restricted to the description of the preferred embodiments given above.

What is claimed is:

1. A beverage transporting and dispensing package comprising:

a carton having front and rear panels and first and second spaced side panels extending between the front and rear panels, the panels having upper and lower portions and together defining a chamber and an upper opening, the chamber having an upper edge;

a spout-securing panel extending into the upper opening, the spout-securing panel being continuous with the chamber along the upper edge thereof and having upper and lower surfaces;

two flaccid beverage bags within the chamber, each having top and bottom portions;

a fill spout attached to the top portion of each bag, each fill spout extending through and secured with respect to the spout-securing panel;

a dispensing device attached to the bottom portion of each bag, each dispensing device extending through and secured with respect to the lower portion of the front panel; and a bag-separation panel extending between the bags.

2. The beverage transporting and dispensing package of claim 1 wherein the bag-separation panel is attached to the front panel and the rear panel and has an upper edge abutting to the lower surface of the spout-securing panel.

3. The beverage transporting and dispensing package of claim 1 further including a cover panel extending over the spout-securing panel.

4. The beverage transporting and dispensing package of claim 3 wherein:

the front panel has an upper edge forming a portion of the upper edge of the chamber; and the cover panel is contiguous with the front panel along the upper edge thereof and non-contiguous with the snout-securing panel.

5. The beverage transporting and dispensing package of claim 1 wherein the upper portions of the side panels each have a handle opening therein.

6. The beverage transporting and dispensing package of claim 1 wherein:

the front panel, rear panel, side panels and spout-securing panel are parts of a unitary foldable blank erected to form the carton;

the spout-securing panel has a pair of pre-cut fill apertures each receiving one of the fill spouts; and the front panel has a pair of pre-cut dispensing apertures each receiving one of the dispensing devices.

7. The beverage transporting and dispensing package of claim 6 wherein the blank further includes the bag-separation panel.

8. The beverage transporting and dispensing package of claim 7 wherein the unitary blank is formed of corrugated cardboard material.

9. The beverage transporting and dispensing package of claim 8 wherein:

the front panel, rear panel and side panels each have a lower edge; and the erected blank further includes bottom flaps, each bottom flap being contiguous with one of the front, rear and side panels along the respective lower edges thereof, such flaps being folded in and up along the front, rear and side panels, respectively, to reinforce the package.

10. The beverage transporting and dispensing package of claim 9 wherein the erected blank further includes a bottom panel contiguous with at least one of the bottom flaps.

11. A beverage transporting and dispensing package comprising:

a carton having front and rear panels and first and second spaced side panels extending between the front and rear panels, the panels having upper and lower portions and together defining a chamber and an upper opening;

a spout-securing panel extending into the upper opening, the spout-securing panel having upper and lower surfaces, the spout-securing panel, the front panel, the rear panel, and side panels being parts of a unitary foldable blank erected to form the carton, wherein:

the rear panel is formed of first and second non-contiguous rear-panel sections of the blank which overlap and adhere to one another; and the spout-securing panel is formed of first and second non-contiguous spout-panel sections of the blank which overlap and adhere to one another, the first and second spout-panel sections being contiguous with the first and second rear-panel sections, respectively;

two flaccid beverage bags within the chamber, each having top and bottom portions;

a fill snout attached to the top portion of each bag, each fill snout extending through and secured with respect to the spout-securing panel, the spout-securing panel having a pair of pre-cut fill apertures to receive each of the fill spouts, one of the pre-cut fill apertures being in each of the spout-panel sections;

a dispensing device attached to the bottom portion of each bag, each dispensing device extending through and secured with respect to the lower portion of the front panel, the front panel having a pair of pre-cut dispensing apertures to receive each of the dispensing devices; and a bag-separation panel extending between the bags.

12. The beverage transporting and dispensing package of claim 11 wherein:

one of the overlapping rear-panel sections is an inner section; and the blank further includes the bag-separation panel, the bag-separation panel being contiguous with the inner section.

13. The beverage transporting and dispensing package of claim 12 wherein the erected blank further includes a cover panel extending over the spout-securing panel.

14. The beverage transporting and dispensing package of claim 13 wherein:

the front panel has an upper edge; and the cover panel is contiguous with the front panel along the upper edge thereof.

15. A unitary corrugated cardboard blank erectable into a carton for transporting and dispensing two beverages, comprising:

a first rear-panel section, a first side panel, a front panel, a second side panel, and a second rear-panel section all in contiguous ordered seriatim relationship, the rear-panel sections being non-contiguous with respect to each other and having non-contiguous overlap portions which, when adhered to one another, form a rear panel of the carton;

each of the panels and rear-panel sections having upper and lower edges and upper and lower portions and each rear-panel section also having a lateral edge terminating its overlap portion;

first and second non-contiguous spout-panel sections contiguous with the first and second rear-panel sections, respectively, along the upper edges thereof, the spout-panel sections having non-contiguous overlap portions which, when adhered to one another, form a spout-securing panel of the carton;

a bag-separation panel contiguous with one of the rear-panel sections along the lateral edge thereof;

each of the spout-panel sections having a pre-cut fill aperture therein to accommodate fill spouts of two beverage bags; and the front panel having a pair of pre-cut dispensing apertures in the lower portion thereof to accommodate dispensing devices of the two bags.

16. The unitary corrugated cardboard blank of claim 15 further including a cover panel contiguous with the front panel along the upper edge thereof.

17. The unitary corrugated cardboard blank of claim 15 further including bottom flaps, each bottom flap being contiguous with one of the side panels, front panel and rear-panel sections along the lower edges thereof.

18. The unitary corrugated cardboard blank of claim 17 further including:

first and second bottom flaps contiguous with the lower edges of the first and second rear-panel sections, respectively;

third and fourth bottom flaps contiguous with the lower edges of the first and second side panels, respectively;

a bottom fold contiguous with the lower edge of the front panel and having a lateral edge opposite the lower edge of the front panel;

a bottom panel contiguous with the lateral edge of the bottom fold; and each bottom flap having a lock tab and the bottom panel having four slots such that folding the bottom flaps and bottom fold when the blank is erected allows the lock tabs to be inserted into the respective slot on the bottom panel and thereby form a bottom to the package.

19. The unitary corrugated cardboard blank of claim 15 wherein the two rear-panel overlap portions are adhered to one another and the two spout-panel overlap portions are adhered to one another to form a pre-erected carton.

20. The unitary corrugated cardboard blank of claim 19 further including:

two flaccid beverage bags attached within the pre-erected carton, each bag separated by the bag-separation panel and having top and bottom portions; and a dispensing device attached to the bottom portion of each bag, each dispensing device extending through and secured with respect to the lower portion of the front panel.

21. A method for providing two beverages in amounts for consumption by multiple persons by their selective dispensing over an extended time, comprising:

providing a unitary non-erected carton that is erectable to form an upright carton enclosing two flaccid bags in horizontally-adjacent side-by-side positions on either side of a bag-separation panel, the upright carton having a lateral wall and a pair of dispensing devices, one on each of the bags, extending through and secured to a lower portion of the lateral wall, wherein the two flaccid bags each have top and bottom portions with the dispensing devices on the bottom portions and fill spouts on the top portions of the bags, each fill spout being secured to an upper portion that is integral with other portions of the erected carton;

erecting the carton;

filling the two bags with two beverages through their fill spouts and then closing the fill spouts;

transporting the filled carton to the place of use; and selectively dispensing the two beverages to cups held beneath the two dispensing devices.

22. The method of claim 21 further including placing a cover on top of the carton to enclose the fill spouts within the carton after the fill spouts are closed.

23. A beverage transporting and dispensing package comprising a unitary erectable carton which, in erected condition, has (a) a lateral wall with a lower portion, (b) two flaccid beverage bags enclosed in the carton in horizontally-adjacent side-by-side positions, each flaccid bag having a ton portion and a bottom portion, (c) a bag-separation panel between the bags, (d) a pair of fill spouts, one on the top portion of each bag, extending through and secured with respect to a spout-securing panel integral with the lateral wall, and (e) a pair of dispensing devices, one on the bottom portion of each bag, extending through and secured to a lower portion of the lateral wall.

24. The beverage transporting and dispensing package of claim 23 wherein the bag-separation panel is integral with other portions of the carton.

25. The beverage transporting and dispensing package of claim 23 wherein the carton further includes a cover enclosing the fill spouts.

* * * * *

UNITED STATES PATENT AND TRADEMARK OFFICE

CERTIFICATE OF CORRECTION

PATENT NO. : 6,755,324 B2
DATED : June 29, 2004
INVENTOR(S) : James F. Geshay

It is certified that error appears in the above-identified patent and that said Letters Patent is hereby corrected as shown below:

Column 8,
Line 30, after the words “panel being”, delete “continuous” and add -- contiguous --;

Column 9,
Line 43, after the words “a fill”, delete “snout” and add -- spout --;
Line 44, after the word “fill”, delete “snout” and add -- spout --;

Column 12,
Line 11, delete first word “ton” and add -- top --.

Signed and Sealed this

Seventh Day of September, 2004

JON W. DUDAS
*Director of the United States Patent and Trademark Office*